US012790744B2

(12) United States Patent
De Wever et al.

(10) Patent No.: US 12,790,744 B2
(45) Date of Patent: Nov. 10, 2026

(54) NONWOVEN COMPOSITE STRUCTURE WITH EXCELLENT WATER VAPOUR PERMEABILITY

(71) Applicant: Borealis AG, Vienna (AT)

(72) Inventors: Willem De Wever, Hasselt (BE); Henk Van Paridon, Averbode (BE); Gustaf Tobieson, Stenungsund (SE); Auli Nummila-Pakarinen, Kulloo (FI); Jingbo Wang, Linz (AT)

(73) Assignee: BOREALIS GMBH, Vienna (AT)

( * ) Notice: Subject to any disclaimer, the term of this patent is extended or adjusted under 35 U.S.C. 154(b) by 300 days.

(21) Appl. No.: 18/011,551

(22) PCT Filed: Jun. 23, 2021

(86) PCT No.: PCT/EP2021/067226
§ 371 (c)(1),
(2) Date: Dec. 20, 2022

(87) PCT Pub. No.: WO2021/260053
PCT Pub. Date: Dec. 30, 2021

(65) Prior Publication Data

US 2023/0257934 A1 Aug. 17, 2023

(30) Foreign Application Priority Data

Jun. 26, 2020 (EP) ..... 20182632

(51) Int. Cl.
*D06N 3/04* (2006.01)
*D01D 5/08* (2006.01)
*D06N 3/00* (2006.01)

(52) U.S. Cl.
CPC ..... *D06N 3/045* (2013.01); *D01D 5/08* (2013.01); *D06N 3/0011* (2013.01); *D06N 3/0038* (2013.01); *D06N 3/0088* (2013.01); *D06N 2201/0254* (2013.01); *D06N 2203/042* (2013.01); *D06N 2211/06* (2013.01); *D06N 2211/18* (2013.01); *D06N 2211/24* (2013.01)

(58) Field of Classification Search
CPC ..... D06N 3/0011; B32B 2307/7246; B32B 5/022; B32B 2255/02; B32B 2255/26
See application file for complete search history.

(56) References Cited

U.S. PATENT DOCUMENTS

| | | | | |
|---|---|---|---|---|
| 6,235,658 | B1 | 5/2001 | Panzer et al. | |
| 6,300,257 | B1 | 10/2001 | Kirchberger et al. | |
| 10,569,517 | B2 | 2/2020 | Chou | |
| 2003/0215609 | A1* | 11/2003 | Burkart | E04D 13/1625 52/95 |
| 2004/0122396 | A1 | 6/2004 | Maldonado et al. | |
| 2007/0178784 | A1 | 8/2007 | Jones et al. | |
| 2008/0019617 | A1 | 1/2008 | Rasquinha et al. | |
| 2011/0151185 | A1 | 6/2011 | Cree | |
| 2012/0328841 | A1 | 12/2012 | Afshari | |
| 2013/0210304 | A1* | 8/2013 | Tynys | D06N 3/0011 442/76 |
| 2015/0175792 | A1 | 6/2015 | Chou et al. | |

FOREIGN PATENT DOCUMENTS

| | | | |
|---|---|---|---|
| EP | 1547839 | A1 | 6/2005 |
| EP | 1892264 | A | 2/2008 |
| EP | 2390092 | B2 | 11/2011 |
| JP | 201348766 | A | 12/2001 |
| WO | 02066246 | A1 | 8/2002 |
| WO | 2004067604 | A1 | 8/2004 |
| WO | 2010120474 | A2 | 10/2010 |
| WO | 2011003052 | A1 | 1/2011 |
| WO | 2017118612 | A1 | 7/2017 |

OTHER PUBLICATIONS

Oxford English Definition of "Composite" (Year: 2025).*
International Search Report of Appilcation No. PCT/EP2021/067226 Dated Aug. 19, 2021.
European Office Action application No. 21736288.8 dated Jan. 22, 2024.

* cited by examiner

*Primary Examiner* — Jenna N Chandhok
(74) *Attorney, Agent, or Firm* — Lippes Mathias LLP

(57) ABSTRACT

The present invention relates to a composite comprising a nonwoven fabric being the substrate of the composite, wherein the nonwoven fabric comprises a polymer (A) selected from the group consisting of polyethylene, polypropylene, polyethylene terephthalate and polyamide; and a coating layer, wherein the coating layer comprises a polymer (B), wherein said polymer is an ethylene copolymer, preferably a polar ethylene copolymer; whereby the coating layer overlays at least one surface of the nonwoven fabric; and whereby the composite has a water vapor transmission rate (WTVR) according to ASTM E-96 ((water cup method) at 38° C. at 50% RH at the outside of the sample and 100% RH at the inside of the samples) of more than 50 g/[$m^2$/24 h], preferably of more than 100 g/[$m^2$/24 h].

14 Claims, No Drawings

NONWOVEN COMPOSITE STRUCTURE WITH EXCELLENT WATER VAPOUR PERMEABILITY

CROSS REFERENCE TO RELATED APPLICATIONS

This is a 371 of PCT Application No. PCT/EP2021/067226, filed Jun. 23, 2021, which claims the benefit of European Application No. 20182632.8, filed Jun. 26, 2020, the contents of which are incorporated herein in their entirety.

The present invention relates to a composite comprising a nonwoven fabric and a coating layer comprising a polar ethylene copolymer, the preparation of a composite structure, the use of a polar ethylene copolymer as a coating layer, and the use of the composite.

Nonwoven fabrics typically have good moisture vapor permeability but poor barrier properties. A nonwoven fabric is a fabric-like material made from long fibers, bonded together by chemical, mechanical, heat or solvent treatment.

In many application areas such as hygiene products, clothing or housing materials a breathable material with good vapor permeability combined with good barrier properties is needed. The solutions currently available are often based on a laminate of a breathable film and a nonwoven fabric. These systems are for example used for protective clothing and diaper back sheets.

EP 2390092 B1 describes a coated nonwoven fabric comprising a nonwoven fabric layer and a coating, said coating comprises a polymer having a branching index g' of equal or below 0.9. The water vapor transition rate of the composites described by EP 2390092 B1 is rather low.

Hence, there is a need for composite structures comprising a substrate material and a coating layer having good water vapor transition properties and also allowing a simplified production of the composite.

It is the object of the present invention to provide a composite having improved breathability with good barrier properties. Further, these properties should be accessible in a simplified production process.

The object of the present invention is solved by a composite comprising, or consisting of,

- a nonwoven fabric being the substrate of the composite, wherein the nonwoven fabric comprises a polymer (A) selected from the group consisting of polyethylene, polypropylene, polyethylene terephthalate and polyamide; and
- a coating layer, wherein the coating layer comprises a polymer (B), wherein said polymer is an ethylene copolymer, preferably a polar ethylene copolymer;

whereby the coating layer overlays at least one surface of the nonwoven fabric; and whereby the composite has a water vapor transmission rate (WTVR) according to ASTM E-96 ((water cup method) at 38° C. at 50% RH at the outside of the sample and 100% RH at the inside of the samples) of more than 50 g/[$m^2$/24 h], preferably of more than 100 g/[$m^2$/24 h].

Surprisingly it has been found that with such composite even in cases of rather thin coating layers superior breathability and good barrier properties are achieved. The coating layer provides good barrier properties and has such characteristics that the laminate structure, that is the composite, has a high water vapor permeation rate. This allows the use of rather thin coating layers. Furthermore, it is not necessary to provide an adhesive to combine the substrate of the composite with the coating layer. The mechanical strength of the composite comes from the nonwoven layer. The composite can be produced cost effectively as the coating layer is thin and no adhesives are needed and a converting (laminating) step is not needed to combine the layers.

According to another aspect the present invention relates to a process for the preparation of an inventive composite comprising, or consisting of, the steps of (a) extruding polymer (B); and (b) coating the nonwoven fabric with the extruded polymer (B).

A further aspect relates to the use of polymer (B) according to the invention as a coating layer on a nonwoven fabric.

Another aspect of the invention relates to the use of the inventive composite for hygiene and medical products, roofing material, housing material, and construction material.

In the following the present invention is described in more detail.

At least one surface of the substrate, i.e. the nonwoven fabric, is coated with a barrier layer. Nonwoven fabrics can be used for many applications, as for instance in hygiene articles like baby diapers and adult incontinence products as well as construction products like roofing membranes. For such applications at least one surface, i.e. the upper and/or the lower surface, is coated with a polymer constituting the barrier layer. Depending on the specific purposes both surfaces or one of the both are coated with a barrier polymer. The barrier layer is also referred to as coating layer.

It is particularly preferred that only one surface of the nonwoven fabric is coated with a coating layer comprising a barrier polymer, namely polymer (B).

According to another embodiment, the inventive composite comprises two nonwoven fabrics, wherein the coating layer constitutes the intermediate layer between the two nonwoven fabrics. In this case the two nonwoven fabrics can be different or identical in chemical (like type of polymer) and physical constitution (like weight, thickness, barrier properties).

Preferably the nonwoven fabric which is the substrate of the composite has a weight per unit area of from 1 to 500 g/$m^2$, preferably from 1 to 300 g/$m^2$, more preferably from 2.5 to 100 g/$m^2$, even more preferably from 2.5 to 50 g/$m^2$, and most preferably from 5 to 20 g/$m^2$.

Even more preferred the nonwoven fabric of the composite is a spunbonded fabric, a melt blown fabric or a combination of both generally called an "SMS"-web. Spunbonded fabrics are being preferred.

In case the nonwoven fabric, that is the substrate, of the composite is a spunbonded fabric it is preferred that the fibers of the fabric have an (average) diameter of not more than 30.0 μm, like below 25.0 μm, more preferably of not more than 20.0 μm. It is in particular appreciated that the (average) diameter of the fibers is in the range of 8.0 to 25.0 μm, more preferably in the range of 10.0 to 20.0 μm. Preferably the fibers of the fabric have an (average) diameter of not less than 400 nm.

In case the nonwoven fabric, that is the substrate, of the composite is a melt blown fabric it is preferred that the fibers of the fabric have an (average) diameter of not more than 12.0 μm, like below 10.0 μm, more preferably of not more than 8.0 μm. It is in particular appreciated that the (average) diameter of the fibers is in the range of 0.1 to 12.0 μm, like 0.2 to below 10.0 μm, more preferably in the range of 0.5 to 8.0 μm, and even more preferably in the range of 0.5 to 4.0 μm.

In one preferred embodiment polymer fibers, preferably propylene fibers, used for producing the nonwoven fabric have an average filament fineness of not more than 2.0 denier and more preferably of not more than 1.9 denier. Preferably, the polypropylene fibers have an average filament fineness greater than 0.2 denier, more preferably of greater than 0.3 denier.

The fiber fineness may for example be in the range of 0.5 to 2.0 denier, preferably 1.0 to 1.9 denier.

The polymer (A) used for the preparation of the nonwoven fabric is selected from the group consisting of polyethylene, polypropylene, polyethylene terephthalate and polyamide.

It is in particularly preferred that the nonwoven fabric comprises, preferably consists of, at least 80 wt. %, more preferably at least 90 wt. %, and even more preferably at least 95 wt. % of a polymer (A) selected from the group consisting of polyethylene, polypropylene, polyethylene terephthalate and polyamide. Further preferred the nonwoven fabric consists of a polymer (A) selected from the group consisting of polyethylene, polypropylene, polyethylene terephthalate and polyamide.

Furthermore, the nonwoven fabric may comprise in addition to the polymer as defined above typical additives, like antioxidants stabilizers, fillers, colorants, nucleating agents and mold release agents. Primary and secondary antioxidants include, for example, hindered phenols, hindered amines, and phosphates.

Nucleating agents include, for example, sodium benzoate, sorbitol derivatives like bis-(3,4-dimethylbenzylidene)-sorbitol and nonitol derivatives like 1,2,3-trideoxy-4,6:5,7-bis-O[(4-propylphenyl)methylene]-nonitol. Other additives such as dispersing agents like glycerol monostearate can also be included. Slip agents include, for example, oleamide and erucamide. Catalyst deactivators are also commonly used, for example, calcium stearate, hydrotalcite, and calcium oxide, and/or other acid neutralizers known in the art. The amount of such additives however shall preferably not exceed 10 wt. %, more preferably not more than 5 wt. %, based on the nonwoven fabric.

According to a preferred embodiment the nonwoven fabric may contain additives, in particular the additives mentioned above, but no other polymers as defined above.

According to a preferred embodiment the nonwoven fabric is a spunbonded fabric, preferably the spunbonded fabric comprises, consists of, a polypropylene as polymer (A) having a melt flow rate $MFR_2$ (230° C., 2.16 kg) measured according to ISO 1133 in the range of from 8 to 80 g/10 min, preferably from 13 to 60 g/10 min, more preferably from 15 to 45 g/10min, and even more preferably from 20 to 45 g/10 min; and/or a molecular weight distribution (MWD) measured according to ISO 16014 of not more than 6.0.

It is in particular preferred that the polymer (A) used for the preparation of the nonwoven fabric is polypropylene.

It is preferred that polymer (A) is a polypropylene homo- or copolymer, preferably a propylene homopolymer i.e. preferably it consists of propylene monomer units and up to 1 wt. % of other olefin monomers such as ethylene, more preferably it consists of propylene monomer units and up to 0.5 wt. % of other olefin monomers such as ethylene, and most preferably it consists of propylene monomer units.

Preferably polymer (A) is a polypropylene having a molecular weight distribution (MWD) measured according to ISO 16014 of from 1 to 6.0, preferably of from 1.5 to 5.7, and more preferably of from 2.0 to 5.3.

According to a preferred embodiment polymer (A) is a propylene homopolymer having a $MFR_2$ (230° C., 2.16 kg) measured according to ISO 1133 in the range of from 8 to 80 g/10 min, preferably from 13 to 60 g/10 min, more preferably from 15 to 45 g/10min, and even more preferably from 20 to 45 g/10 min.

Furthermore, the polypropylene preferably has a flexural modulus as determined according to ISO 178 on injection moulded specimens of from 1200 to 1800 MPa, more preferably in the range of from 1250 to 1650 MPa, and most preferably in the range of from 1300 to 1600 MPa.

Preferably the melting temperature, $T_m$, as determined by DSC according to ISO 11357 of the polypropylene, polymer (A), is from 145° C. to 165° C., preferably from 150 to 164° C.

Further preferred the polypropylene, polymer (A), has a crystallization temperature, $T_c$, as determined by DSC according to ISO 11357 in the range of from 100 to 130° C. and more preferably in the range of from105° C. to 125° C.

The nonwoven fabric comprises, preferably consists of, a polypropylene composition which comprises, preferably consists of, polymer (A) being the main polypropylene component of this composition.

The polypropylene composition comprising polymer (A) may comprise one or more usual additives, preferably in a total amount of from 0.01 up to 5.0 wt. %, more preferably from 0.05 to 3.0 wt. %, selected from the group comprising slip agents, anti-block agents, UV stabilizers, antistatic agents, alpha-nucleating agents and antioxidants.

Slip agents migrate to the surface and act as lubricants polymer to polymer and polymer against metal rollers, giving reduced coefficient of friction (CoF) as a result. Examples are fatty acid amids, like erucamide (CAS No. 112-84-5), oleamide (CAS No. 301-02-0), stearamide (CAS No. 124-26-5) or combinations thereof.

Examples of antioxidant are sterically hindered phenols (such as CAS No. 6683-19-8, also sold as Irganox 1010 FF™ by BASF), phosphorous based antioxidants (such as CAS No. 31570-04-4, also sold as Hostanox PAR 24 (FF)™ by Clariant, or Irgafos 168 (FF)™ by BASF), sulphur based antioxidants (such as CAS No. 693-36-7, sold as Irganox PS-802 FL™ by BASF), nitrogen-based antioxidants (such as 4,4'-bis(1,1'-dimethylbenzyl)diphenylamine), or antioxidant blends.

Examples for acid scavengers are calcium stearates, sodium stearates, zinc stearates, magnesium and zinc oxides, synthetic hydrotalcite (e.g. SHT, CAS No. 11097-59-9), lactates and lactylates, as well as calcium stearate (CAS No. 1592-23-0) and zinc stearate (CAS No. 557-05-1).

Common antiblocking agents are natural silica such as diatomaceous earth (such as CAS No.60676-86-0 (Superf-Floss™), CAS No. 60676-86-0 (SuperFloss E™), or CAS No. 60676-86-0 (Celite 499™)), synthetic silica (such as CAS No. 7631-86-9, or CAS No. 112926-00-8), silicates (such as aluminium silicate (Kaolin) CAS No. 1318-74-7, sodium aluminum silicate CAS No. 1344-00-9, calcined kaolin CAS No. 92704-41-1, aluminum silicate CAS No. 1327-36-2, or calcium silicate CAS No. 1344-95-2), synthetic zeolites (such as sodium calcium aluminosilicate hydrate CAS No. 1344-01-0, or sodium calcium aluminosilicate, hydrate).

Suitable UV-stabilisers are, for example, Bis-(2,2,6,6-tetramethyl-4-piperidyl)-sebacate (CAS No. 52829-07-9, Tinuvin 770); 2-hydroxy-4-n-octoxy-benzophenone (CAS No. 1843-05-6, Chimassorb 81).

Alpha nucleating agents like sodium benzoate (CAS No. 532-32-1); a mixture of aluminium-hydroxy-bis[2,2'-methylene-bis(4,6-di-t-butylphenyl)phosphate] and lithium myristate (commercially available as Adekastab NA-21 of Adeka Palmarole, France) or 1,3:2,4-bis(3,4- dimethylbenzylidene)sorbitol (CAS No. 135861-56-2, commercially available as Millad 3988 of Milliken, USA) can also be added.

Suitable antistatic agents are, for example, glycerol esters (CAS No. 97593-29-8) or ethoxylated amines (CAS No. 71786-60-2 or 61791-31-9) or ethoxylated amides (CAS No. 204-393-1).

Usually these additives are added in quantities of 100-1.000 ppm for each single component.

Preferably at least an antioxidant is added to the composition of the invention.

The catalyst used for producing the polypropylene influences in particular the microstructure of the polymer. Accordingly, polypropylenes prepared by using a metallocene catalyst provide a different microstructure compared to those prepared by using Ziegler-Natta (ZN) catalysts. The most significant difference is the presence of regio-defects in metallocene-made polypropylenes which is not the case for polypropylenes made by ZN catalysts.

The regio-defects of propylene polymers can be of three different types, namely 2,1-erythro (2,Ie), 2,1-threo (2,It) and 3,1 defects. A detailed description of the structure and mechanism of formation of region-defects in polypropylene can be found in Chemical Reviews 2000, 100(4), pages 1316-1327. These defects are measured using $^{13}C$ NMR by methods known in the art. The term "2,1 regio defects" as used in the present invention defines the sum of 2,1-erythro regio-defects and 2,1-threo regio-defects.

Preferably, the number of 2,1 and 3,1 regio-defects in the polypropylene is from 0.01 to 1.50 mol % as measured by $^{13}C$ NMR.

According to a first specific embodiment polypropylenes having a number of regio-defects as required for polymer (A) to be used to produce the nonwoven of the invention are usually and preferably prepared in the presence of a single-site catalyst.

It is preferred that the polypropylene composition comprises at least 80 wt. % of the polypropylene, more preferably at least 90 wt. % of the polypropylene and most preferably the polypropylene is the only polymeric component present in the composition, i.e. the polypropylene composition consists of the polypropylene, polymer (A), and, optionally, contains one or more additives such as described herein. The amount of additives, if present, is usually 5 wt. % or less, preferably 3 wt. % or less.

The polypropylene according to this embodiment preferably has a comparatively small molecular weight distribution as determined by GPC. Thus, preferably the polypropylene has a MWD of 2.0 to 4.5, more preferably of 2.5 to 4.5, and still more preferably of 2.7 to 4.0.

The melting temperature, $T_m$, as determined by DSC according to ISO 11357 of the polypropylene is from 145° C. to 165° C., preferably from 150° C. to 164° C., and even more from preferably 153° C. to 157° C.

The polypropylene has preferably a melt flow rate $MFR_2$ (230° C., 2.16 kg) measured according to ISO 1133 in the range of from 8 to 80 g/10 min, preferably from 13 to 60 g/10 min, more preferably from 15 to 45 g/10 min, and even more preferably from 20 to 45 g/10 min.

Still further, the polypropylene of this specific embodiment has the advantage of having only a low amount of hexane extractables. Thus, it is preferred that the polypropylene has a hexane extractables content as measured according to the FDA test of less than 2.0 wt. %, more preferably of less than 1.5 wt. %.

In order to facilitate processing it is also desirable that the polypropylene has a suitable crystallization temperature even in absence of any nucleating agents.

Thus, preferably, the polypropylene has a crystallization temperature, $T_c$, as determined by DSC according to ISO 11357 in the range of 100° C. to 130° C., more preferably in the range of 105° C. to 125° C., like in the range of 110° C. to 120° C.

The polypropylene preferably has a xylene cold soluble (XCS) fraction as determined according to ISO 16152 of from 0.1 to below 4.0 wt. %, more preferably of from 0.1 to 2.5 wt. %, and most preferably from 0.2 to 2.0 wt. %.

Furthermore, the polypropylene preferably has a flexural modulus as determined according to ISO 178 on injection moulded specimen of 1200 to 1800 MPa, more preferably in the range of 1250 to 1650 MPa, and most preferably in the range of 1300 to 1600 MPa.

Preferably, the polypropylene comprises, or consists of, two polymer fractions (A-1) and (A-2). The split between fractions (A-1) and (A-2) is preferably from 30:70 to 70:30, more preferably is from 45:55 to 65:35, and most preferably is from 55:45 to 60:40.

Optionally, a small fraction of prepolymer, which typically is a propylene homopolymer, in an amount of usually below 5 wt. %, may also be present in the polypropylene.

Furthermore, it is preferred that polymer (A-1) has a melt flow rate $MFR_2$ (230° C.; 2.16 kg) measured according to ISO 1133 in the range of from 8 to 80 g/10 min, preferably from 13 to 60 g/10 min, more preferably from 15 to 45 g/10 min, and even more preferably from 20 to 45 g/10 min, and/or that (A-2) has a melt flow rate $MFR_2$ (230° C.; 2.16kg) measured according to ISO 1133 in the range of from 8 to 80 g/10 min, preferably from 13 to 60 g/10 min, more preferably from 15 to 45 g/10 min, and even more preferably from 20 to 45 g/10 min.

According to one preferred embodiment, the polypropylene is produced in the presence of a metallocene catalyst, which is preferably a metallocene catalyst comprising a complex in any one of the embodiments as described in WO 2013/007650, WO 2015/158790 and WO 2018/122134.

To form an active catalytic species it is normally necessary to employ a cocatalyst as is well known in the art. Cocatalysts comprising one or more compounds of Group 13 metals, like organoaluminium compounds or boron containing cocatalysts or combinations thereof used to activate metallocene catalysts are suitable for use in this invention.

In a preferred embodiment of the present invention a cocatalyst system comprising a boron containing cocatalyst, e.g. a borate cocatalyst and an aluminoxane cocatalyst is used. Suitable cocatalysts are described in WO 2013/007650, WO 2015/158790 and WO 2018/122134 and it is preferred that a cocatalyst in any one of the embodiments as described therein is used. The catalyst system used to manufacture the polypropylene is ideally provided in solid particulate form supported on an external carrier. The particulate support material used is silica or a mixed oxide such as silica-alumina. The use of a silica support is preferred. Especially preferably the support is a porous material so that the complex may be loaded into the pores of the particulate support, e.g. using a process analogous to those described in WO 94/14856, WO 95/12622 and WO 2006/097497. The preparation of the solid catalyst system is also described in WO2013/007650, WO2015/158790 and WO2018/122134 and it is preferred that the catalyst system is prepared according to any one of the embodiments described therein.

According to a second specific embodiment polymer (A) is a propylene homopolymer produced in the presence of a Ziegler-Natta catalyst. Particular preferred propylene homopolymers, their preparation as well as the applied catalysts and the preparation of nonwoven fabrics therefrom are described in WO 2017/118612 A1 which is hereby incorporated by reference.

Preferably the polypropylene homopolymer according to this embodiment can contain below 0.8 wt % of a $C_2$ or $C_4$ to $C_{10}$ alpha olefin comonomer, preferably a maximum of 0.7 wt %, still more preferably of a maximum of 0.6 wt %, like of a maximum of 0.5 wt % or 0.1 wt % of a $C_2$ or $C_4$ to $C_{10}$ alpha olefin comonomer. Such comonomers can be selected for example from ethylene, 1-butene, 1-hexene and 1-octene. Preferably the comonomer, if present, is ethylene.

Alternatively only propylene units are detectable, i.e. only propylene has been polymerized. In this case the amount of comonomer is 0.0 wt %.

The $MFR_2$ (230° C., 2.16 kg) measured according to ISO 1133 is in the range of from 8 to 80 g/10 min. Preferably the polypropylene homopolymer has an $MFR_2$ of from 13 to 60 g/10 min, more preferably from 15 to 45 g/10 min, and even more preferably from 20 to 45 g/10 min.

The molecular weight distribution (Mw/Mn) of the polypropylene homopolymer according to this second specific embodiment is >4.3 (measured by size exclusion chromatography according to ISO 16014), preferably above 4.5.

The propylene homopolymer is preferably a crystalline propylene homopolymer. The term "crystalline" indicates that the propylene homopolymer has a rather high melting temperature. Accordingly throughout the invention the propylene homopolymer is regarded as crystalline unless otherwise indicated. Therefore, the propylene homopolymer has a melting temperature, $T_m$, measured by differential scanning calorimetry (DSC, ISO 11357) in the range of 150° C. to 164° C., preferably in the range of 155° C. to 162° C.

Furthermore the polypropylene homopolymer is free of phthalic acid esters as well as their respective decomposition products.

It is preferred that the propylene homopolymer is featured by rather high cold xylene soluble (XCS) content, i.e. by a xylene cold soluble (XCS) of at least 2.5 wt. %, like at least 3.0 wt. % or at least 3.5 wt. %. Accordingly, the propylene homopolymer has preferably a xylene cold soluble content (XCS) in the range of 2.5 to 5.5 wt. %, more preferably in the range of 3.0 to 5.0 wt. % and even more preferred in the range of 3.5 to 5.0 wt. %. The amount of xylene cold solubles (XCS) additionally indicates that the propylene homopolymer is preferably free of any elastomeric polymer component, like an ethylene propylene rubber. In other words, the propylene homopolymer shall be not a heterophasic polypropylene, i.e. a system consisting of a polypropylene matrix in which an elastomeric phase is dispersed. Such systems are featured by a rather high xylene cold soluble content.

Further it is preferred that the propylene homopolymer has a crystallization temperature, $T_c$, determined by DSC according to ISO 11357 of equal or more than 105° C., more preferably in the range of 108° C. to 130° C., more preferably in the range of 110° C. to 125° C.

The polypropylene homopolymer suitable for this second specific embodiment is in addition preferably visbroken. Thus the melt flow rate (230° C./2.16 kg, ISO 1133) of the polypropylene homopolymer before visbreaking is much lower, like from 0.5 to 50 g/10 min. For example, the melt flow rate (230° C./2.16 kg) of the polypropylene homopolymer before visbreaking is from 1.0 to 45 g/10 min, like from 1.5 to 40 g/10 min.

The ratio of the MFR after visbreaking [MFR final] to the MFR before visbreaking [MFR start] [MFR final]/[MFR start] is >5.

Preferably the polypropylene polymer has been visbroken with a visbreaking ratio [final $MFR_2$ (230° C.; 2.16 kg)/start $MFR_2$ (230° C.; 2.16 kg)] of greater than 5 to 50. The "final $MFR_2$ (230° C.; 2.16 kg)" is the $MFR_2$ (230° C.; 2.16 kg) of the polypropylene homopolymer after visbreaking and the "start $MFR_2$ (230° C.; 2.16 kg)" is the $MFR_2$ (230° C.; 2.16 kg) of the polypropylene homopolymer before visbreaking. More preferably, the polypropylene homopolymer has been visbroken with a visbreaking ratio [final $MFR_2$ (230° C.; 2.16 kg)/start $MFR_2$ (230° C.; 2.16 kg)] of 8 to 25. Even more preferably, the polypropylene homopolymer has been visbroken with a visbreaking ratio [final $MFR_2$ (230° C./2.16 kg)/start $MFR_2$ (230° C.; 2.16 kg)] of 10 to 20. As mentioned above, it is an essential feature that the polypropylene homopolymer has been visbroken.

Preferred mixing devices suited for visbreaking are known to a person skilled in the art and can be selected i.a. from discontinuous and continuous kneaders, twin screw extruders and single screw extruders with special mixing sections and co-kneaders and the like.

The visbreaking step according to the present invention is performed either with a peroxide or mixture of peroxides or with a hydroxylamine ester or a mercaptane compound as source of free radicals (visbreaking agent) or by purely thermal degradation.

Typical peroxides being suitable as visbreaking agents are 2,5-dimethyl-2,5-bis(tert.butylperoxy)hexane (DHBP) (for instance sold under the tradenames Luperox 101 and Trigonox 101), 2,5-dimethyl-2,5-bis(tert.butyl-peroxy)hexyne-3 (DYBP) (for instance sold under the tradenames Luperox 130 and Trigonox 145), dicumyl-peroxide (DCUP) (for instance sold under the tradenames Luperox DC and Perkadox BC), di-tert-butyl-peroxide (DTBP) (for instance sold under the tradenames Trigonox B and Luperox Di), tert-butyl-cumyl-peroxide (BCUP) (for instance sold under the tradenames Trigonox T and Luperox 801) and bis(tert-butylperoxy-isopropyl)benzene (DIPP) (for instance sold under the tradenames Perkadox 14S and Luperox DC).

Suitable amounts of peroxide to be employed in accordance with the present invention are in principle known to the skilled person and can easily be calculated on the basis of the amount of propylene homopolymer to be subjected to visbreaking, the $MFR_2$ (230° C.; 2.16 kg) value of the propylene homopolymer to be subjected to visbreaking and the desired target $MFR_2$ (230° C.; 2.16 kg) of the product to be obtained. Accordingly, typical amounts of peroxide visbreaking agent are from 0.005 to 0.5 wt. %, more preferably from 0.01 to 0.2 wt. %, based on the total amount of polypropylene homopolymer employed typically, visbreaking in accordance with the present invention is carried out in an extruder, so that under the suitable conditions, an increase of melt flow rate is obtained. During visbreaking, higher molar mass chains of the starting product are broken statistically more frequently than lower molar mass molecules, resulting as indicated above in an overall decrease of the average molecular weight and an increase in melt flow rate. After visbreaking the polypropylene homopolymer according to this invention is preferably in the form of pellets or granules. The instant polypropylene homopolymer is preferably used in pellet or granule form for the spunbonded fiber process.

The polymer composition comprising, preferably consisting of, polymer (A) is used to prepare a nonwoven fabric which is the substrate of the inventive composite. Hence, the present invention also refers to a process for the preparation of a fabric, preferably a spunbonded fabric.

According to a preferred embodiment the polypropylene homopolymer as defined above is spunbonded by using a fiber spinning line at a maximum cabin air pressure of at least 3000 Pa, preferably of at least 4000 Pa and more preferably of at least 5000 Pa. The cabin air pressure can be up to 10000 Pa, preferably up to 9000 Pa.

The spunbonding process is one which is well known in the art of fabric production. In general, continuous fibers are extruded, laid on an endless belt, and then bonded to each other, and often times to a second layer such as a melt blown layer, often by a heated calender roll, or addition of a binder, or by a mechanical bonding system (entanglement) using needles or hydro jets. A typical spunbonded process consists of a continuous filament extrusion, followed by drawing, web formation by the use of some type of ejector, and bonding of the web, also referred to as fabric. First, pellets or granules of the polypropylene homopolymer as defined above are fed into an extruder. In the extruder, the pellets or granules are melted and forced through the system by a heating melting screw. At the end of the screw, a spinning pump meters the molten polymer through a filter to a spinneret where the molten polymer is extruded under pressure through capillaries, at a rate of 0.3 to 1.0 grams per hole per minute. The spinneret contains between 65 and 75 holes per cm, measuring 0.4 mm to 0.7 mm in diameter. The polypropylene homopolymer is melted at about 30° C. to 150° C. above its melting point to achieve sufficiently low melt viscosity for extrusion. The fibers exiting the spinneret are quenched and drawn into fine fibers measuring at most 20 microns in diameter by cold air jets, reaching filament speeds of at least 2500 m/min. The solidified fiber is laid randomly on a moving belt to form a random netlike structure known in the art as web. After web formation the web is bonded to achieve its final strength using a heated textile calender known in the art as thermobonding calender. The calender consists of two heated steel rolls; one roll is plain and the other bears a pattern of raised points. The web is conveyed to the calender wherein a fabric is formed by pressing the web between the rolls at a bonding temperature of about 140° C. to 160° C.

An essential component of the inventive composite is the coating layer. The coating layer overlays the nonwoven fabric or in an alternative embodiment the coating layer is the intermediate layer between two nonwoven fabrics.

Preferably the coating layer is an extrusion coating layer.

An essential finding of the present invention is that with the specific selection of polymer (B), namely the ethylene copolymer, the coating weight of the coating layer can be rather low without compromising the good barrier properties of the composite and improving the breathability of the coating layer.

In a preferred embodiment polymer (B) of the coating layer is an ethylene copolymer, preferably a polar ethylene copolymer comprising at least one polar comonomer selected from a comonomer containing at least one polar group, preferably the at least one polar comonomer is selected from a comonomer containing hydroxyl group(s), alkoxy group(s), carbonyl group(s), carboxyl group(s), ether group(s), silane group(s) or ester group(s), or a mixture thereof.

It is further preferred that polymer (B) comprises a comonomer selected from the group of acrylates and methacrylates, preferably selected from the group of vinyl acrylate, methyl acrylate and/or ethyl acrylate, preferably methyl acrylate.

Polymer (B) may be selected from the group consisting of an ethylene-vinyl acetate copolymer (EVA), an ethylene-butyl acrylate copolymer (EBA), an ethylene-methyl acrylate copolymer (EMA), and mixtures thereof.

In a preferred embodiment polymer (B) has a comonomer content of from 1 to 80 wt. %, preferably from 5 to 70 wt. %, more preferably from 10 to 60 wt. %, even more preferably from 15 to 50 wt. % and most preferably from 18 to 40 wt. % based on the total amount of polymer (B).

The selection and amount of polar monomers is very important for the improved breathability and good barrier properties of the inventive composite. It plays also a crucial role in the coating process as it allows the omission of adhesives when producing the inventive composite.

For being processable at high speeds the flowability of polymer (B) must be high. In a preferred embodiment the melt flow rate, $MFR_2$ (190° C.; 2.16 kg) measured according to ISO 1133, of polymer (B) is of from 1 to 100 g/10 min, preferably from 3 to 50 g/10 min and more preferably from 5 to 25 g/10 min.

The mentioned melt flow rate is also important for the processability of the coating layer in particular in the coating step. Therefore, according to a preferred embodiment the melt flow rate, $MFR_2$, of the coating layer is of from 1 to 100 g/10 min, preferably from 3 to 50 g/10 min and more preferably from 5 to 25 g/10 min.

The ethylene copolymer (B) is obtained by processes known in the art. Accordingly the ethylene copolymer (B) is in particular obtainable by high-pressure radical polymerization in a tubular or autoclave process at a pressure of 1200 to 3000 bar and a temperature of 150 to 300° C. Suitable processes and products are for example described in the "Encyclopedia of Polymer Science and Technology", Vol. 2, pages 412-441 (Wiley Interscience, 2002).

An alternative way of preparing the ethylene copolymer (B), preferably the ethylene copolymer, comprising at least one polar comonomer, is via reactive extrusion, e.g. mixing the polyethylene and polar monomers in a reactor with and without an initiator. Different polar comonomers can be used and the reaction can be started by any known means, like radiation, peroxide, etc. Suitable processes and products are for example described in Junji Harada, et al., Radiation effects on Polymers, ACS Symposium Series, 1991, chapter 14, 238-250.

Preferably the coating layer comprises at least 80 wt. %, more preferably at least 90 wt. %, even more preferably at least 95 wt. % of the polymer (B). Even further preferred polymer (B) is the only polymer within the coating layer.

The coating layer may comprise in addition to polymer (B) additives such as antioxidants stabilizers, nucleating agents and mold release agents. The amount of such additives however shall preferably not exceed 10 wt. %, more preferably not more than 5 wt. %, based on the coating layer. In a specific embodiment the coating layer may contain additives but no other polymers beside polymer (B).

Even though the coating layer and polymer (B) may comprise additives, the coating layer and the polymer (B) are preferably free of fillers. Fillers according to this invention are preferably particles being chemically inert and/or have a medium particle size of at least 0.05 μm, more preferably of at least 0.1 μm, like of at least 1.0 μm. Typical examples which shall not be present in the coating layer and polymer (B) are silica, particularly in the form of glass or quartz; silicates, particularly talcum; titanates, titanium dioxide, aluminum oxide, kaolin, magnesium oxide, magnesite, iron oxides, silicon carbide, silicon nitride, barium sulfate and/or calcium carbonates.

The coating layer can be further defined by the ash content, which is preferably rather low as preferably only low amounts of additives have been used. Thus it is appreciated that the coating layer has an ash content of equal or below 1.5 wt. %, more preferably of equal or below 1.0 wt. %, yet more preferably below 0.8 wt. %.

Preferably the inventive coating layer is free of pores.

In contrast to known composites in this technical field, the composite of the present invention is not stretched. Thus in a preferred embodiment the composite comprising the non-woven fabric and the coating layer has not been subjected to a stretching step, i.e. is a non-stretched composite. Such stretching steps are commonly used to reduce the thickness of the individual layers, in particular of the barrier layer, that is, the coating layer, to improve the breathability of the overall composite, in particular of the barrier layer, i.e. coating layer.

According to a preferred embodiment of the composite, the coating layer is non-stretched.

Further preferred the coating layer has a weight per unit area of from 0.1 to 30, more preferably from 0.5 to 15 g/m$^2$, more preferably from 0.75 to 10 g/m$^2$, and even more preferably from 1 to 6.5 g/m$^2$.

Such low weights of the coating layer are only achievable with the specific selection of polymer (B) as described hereinbefore.

According to another preferred embodiment of the composite the coating layer is non-stretched; and has a weight per unit area of from 0.1 to 30, more preferably from 0.5 to 15 g/m$^2$, more preferably from 0.75 to 10 g/m$^2$, and even more preferably from 1 to 6.5 g/m$^2$.

According to another embodiment of the composite the coating layer is stretched. The composite and/or the coating layer has a draw ratio in machine direction of below 1:3.0 and a draw ratio in transverse direction of below 1:2.5, more preferably a draw ratio in machine direction of below 1:2.0 and a draw ratio in transverse direction of below 1 :2.0, yet more preferably a draw ratio in machine direction of below 1:1.8 and a draw ratio in transverse direction of below 1:1.8.

A further advantage of the present invention is that between the coating layer and the nonwoven fabric no adhesive is necessary.

According to another preferred embodiment of the composite no adhesive is present between the coating layer and the nonwoven fabric; and/or the coating layer is an extrusion coating layer.

Another aspect of the present invention relates to a process for the preparation of inventive composites comprising, or consisting of, the steps of (a) extruding polymer (B); and (b) coating the nonwoven fabric with the extruded polymer (B).

This process is also referred to in the following as the extrusion coating process.

According to a preferred embodiment the line speed in step (b) is at least 60 m/min.

The extrusion coating process may be carried out using conventional extrusion coating techniques. Hence, the polymer (B) is fed, optionally together with additives, to an extruding device. From the extruder the polymer (B) melt is passed through a flat die to the substrate being the nonwoven fabric to be coated. Due to the distance between the die lip and the nip, the molten plastic is oxidized in the air for a short period, usually leading to an improved adhesion between the coating layer and the substrate. The coated substrate is cooled on a chill roll, after which it is passed to edge trimmers and wound up.

The die width typically depends on the size of the extruder used. Thus with 90 mm extruders the width may suitably be within the range of 600 to 1200 mm, with 115 mm extruders from 900 to 2500 mm, with 150 mm extruders from 1000 to 4000 mm and with 200 mm extruders from 3000 to 5000 mm. The line speed (draw-down speed) is preferably 75 m/min or more, more preferably at least 100 m/min. In most commercially operating machines the line speed is preferably more than 300 m/min or more than 500 m/min. Modern machines are designed to operate at lines speeds of up to 1000 m/min, for instance 300 to 800 m/min.

The temperature of the polymer melt is typically between 240 and 330 ° C.

It is also possible to employ a coating line with at least two extruders to make it possible to produce multilayered coatings with different polymers. Polymer (B) of the invention can be extruded onto the substrate as a monolayer coating or as an outer layer in a co-extrusion process. In a multilayer extrusion coating, a polymer layer structure as defined above and optionally the other polymeric layers may be co-extruded. It is possible to further perform ozone and/or corona treatment in a known way, if desired or necessary.

The coating will typically have an average thickness of 2.0 to 25.0 μm, preferably of 3.0 to 18.0 μm.

According to another aspect the invention relates to the use of inventive polymer (B) as a coating layer on a nonwoven fabric.

Polymer (B) is in particular used to impart a water vapor transmission rate (WVTR) for a coated nonwoven fabric, that is the composite, according to the invention measured according to ASTM E-96 (water cup method) at 38° C. at 50% RH at the outside of the sample and 100% RH at the inside of the samples.

Another aspect of the present invention relates to the use of the inventive composite for hygiene and medical products, roofing material, housing material, and construction material.

Respective products may be diapers, sanitary napkins, panty liners, incontinence products for adults, protective clothing, surgical drapes, surgical gowns, and/or surgical wear.

Unless explicitly described otherwise, the description of the present invention is to be understood so that one or more of any of the above described preferred embodiments of the non-woven fabric, the coating layer and/or the composite of the invention can be combined with the invention described in its most general features.

In the following, the measurement and determination methods for the parameters as used herein are given and the present invention is further illustrated by way of example and comparative example by reference to the figures, which show:

Measurement and Determination Methods

Measurement of Melt Flow Rate $MFR_2$ $MFR_2$ is measured according to ISO 1133 with loading of 2.16 kg, the temperature is 190° C. for polyethylene and 230° C. for polypropylene, respectively.

Water Vapor Transmission Rate (WVTR)

The water vapour permeability, water vapour transmission rate (WVTR) was determined according to ASTM E-96 (water cup method) at 38° C. at 50% RH at the outside of the sample and 100% RH at the inside of the samples.

DSC Analysis, Melting ($T_m$) and Crystallization Temperature ($T_c$)

Data were measured with a TA Instrument Q2000 differential scanning calorimetry (DSC) on 5 to 7 mg samples. DSC is run according to ISO 11357/part 3/method C2 in a heat/cool/heat cycle with a scan rate of 10° C./min in the temperature range of −30 to +225° C.

Crystallization temperature ($T_c$) and crystallization enthalpy ($H_c$) are determined from the cooling step, while melting temperature ($T_m$) and melting enthalpy ($H_m$) are determined from the second heating step.

Molecular Weight Properties

Number average molecular weight (Mn), weight average molecular weight (Mw) and polydispersity (Mw/Mn) were determined by Gel Permeation Chromatography (GPC) according to the following method:

The weight average molecular weight Mw and the polydispersity (Mw/Mn), wherein Mn is the number average molecular weight and Mw is the weight average molecular weight, is measured by a method based on ISO 16014-1: 2003 and ISO 16014-4:2003. A Waters Alliance GPCV 2000 instrument, equipped with refractive index detector and online viscosimeter was used with 3×TSK-gel columns (GMHXL-HT) from TosoHaas and 1,2,4-trichlorobenzene (TCB, stabilized with 200 mg/L 2,6-Di-tert. butyl-4-methylphenol) as solvent at 145° C. and at a constant flow rate of 1 mL/min. 216.5 μl of sample solution were injected per analysis. The column set was calibrated using relative calibration with 19 narrow MWD polystyrene (PS) standards in the range of 0.5 kg/mol to 11 500 kg/mol and a set of well characterized broad polypropylene standards. All samples were prepared by dissolving 5-10 mg of polymer in 10 mL (at 160° C.) of stabilized TCB (same as mobile phase) and keeping for 3 hours with continuous shaking prior sampling in into the GPC instrument.

Xylene Solubles (XCS, Wt. %)

The xylene soluble (XS) fraction as defined and described in the present invention was determined in line with ISO 16152 as follows: 2.0 g of the polymer were dissolved in 250 ml p-xylene at 135° C. under agitation. After 30 minutes, the solution was allowed to cool for 15 minutes at ambient temperature and then allowed to settle for 30 minutes at 25+/−0.5° C. The solution was filtered with filter paper into two 100 ml flasks. The solution from the first 100 ml vessel was evaporated in nitrogen flow and the residue dried under vacuum at 90° C. until constant weight is reached. The xylene soluble fraction (percent) can then be determined as follows:

$$XS\%=(100*m*V0)/(m0*V);$$

m0=initial polymer amount (g);

m=weight of residue (g);

V0=initial volume (ml);

v=volume of analysed sample (ml).

Grammage of the Non-Woven

The unit weight (grammage) of the webs in g/m$^2$ was determined in accordance with ISO 536:1995.

Materials

Polymer A is HG475FB, produced and distributed by Borealis polyolefin AG. It is a polypropylene homopolymer having a narrow molecular weight distribution, with a $MFR_2$ of 27 g/10 min and a $T_m$ of 161° C.

Polymer B: All polymers are Borealis commercial available grades.

Polymer B-1 is Dapoly® WF420HMS, produced and distributed by Borealis polyolefin AG. It is a modified polypropylene having a $MFR_2$ of 22 g/10 min and is intended for extrusion coating.

Polymer B-2 is WG350C, produced and distributed by Borealis polyolefin AG. It is a filled polypropylene grade for extrusion coating having a density of 1040 kg/m$^3$ and a $MFR_2$ of 18 g/10 min.

Polymer B-3: OE2520 is a polyethylene-co-methylacrylate copolymer. It has a methylacrylate content of 20 wt. % and a $MFR_2$ of 8 g/10 min.

All of the mentioned materials are produced and distributed by Borealis polyolefin AG.

EXAMPLES

The spunbonded fabric was produced on a Reicofil 4 machine as described in WO 2017/118612 A1.

A nonwoven substrate being a spunbonded fabric with a weight per unit area of 13 g/m$^2$ has been extrusion coated with different polymers (B-1 to B-3) and coating weights at a line speed of 80 m/min.

Obtained composites (CE1-CE3 & IE) have been evaluated for water vapour permeability, WVTR, according ASTM E-96 (water cup method) at 38° C. at 50% RH at the outside of the sample and 100% RH at the inside of the samples.

Each sample has been tested 4 times and the average and standard deviation have been calculated.

Results of WVTR tests are shown in Table 1.

TABLE 1

| Sample | Weight per unit area Substrate [g/m$^2$] | Polymer of coating layer | Weight per unit area Coating layer [g/m$^2$] | WVTR g/[m$^2$-day] | Stand. dev. |
|---|---|---|---|---|---|
| CE 1 | 13 | B-1 | 3 | 89 | 4 |
| CE 2 | 13 | B-1 | 4 | 53 | 8 |
| CE 3 | 13 | 30% B-1 + 70% B-2 | 7 | 26 | 2 |
| IE | 13 | B-3 | 4 | 605 | 22 |

As can be derived from table 1 the inventive example (IE) shows an extremely high WVTR for a coating weight of 4 g/m$^2$. This is a much better WVTR than all comparative examples 1 to 3 (CE1-CE3) show.

Comparative Examples 1 to 3 demonstrate that a higher coating weight might result in a lower WTVR. However, IE shows that the coating weight is not the main issue, in fact, the structure of the coating layer seems to play a crucial role in water permeability of the composite.

The invention claimed is:

1. Composite comprising a nonwoven fabric being the substrate of the composite, wherein the nonwoven fabric comprises a polymer (A) selected from the group consisting of polyethylene, polypropylene, polyethylene terephthalate and polyamide; and a coating layer, wherein the coating layer comprises a polymer (B), wherein said polymer is an ethylene copolymer comprising a comonomer selected from the group consisting of acrylates and methacrylate, wherein said polymer (B) is free of fillers and wherein the coating layer is free of pores, and wherein the coating layer has a weight per unit area of from 0.1 to 30 g/m$^2$;

whereby the coating layer overlays at least one surface of the nonwoven fabric;

whereby the composite has a water vapor transmission rate (WVTR) according to ASTM E-96 ((water cup method) at 38° C. at 50% RH at the outside of the sample and 100% RH at the inside of the samples) of more than 50 g/[$m^2$/24 h];

wherein no adhesive between the coating layer and the nonwoven fabric is present; and wherein polymer (B) is the only polymer within the coating layer.

2. Composite according to claim 1, wherein polymer (B) has a comonomer content of from 1 to 80 wt. %, based on the total amount of polymer (B).

3. Composite according to claim 1, wherein the melt flow rate, $MFR_2$, determined according to ISO 1133 with loading of 2.16 kg, at 190° C. for polyethylene and 230° C. for polypropylene, of the coating layer is from 1 to 100 g/10 min.

4. Composite according to claim 1, wherein the coating layer (a) is non-stretched, and/or (b) has a weight per unit area of from 0.5 to 15 g/$m^2$.

5. Composite according to claim 1, wherein the nonwoven fabric has a weight per unit area of from 1 to 500 g/$m^2$.

6. Composite according to claim 1, wherein the nonwoven fabric is a spunbonded fabric.

7. Composite according to claim 1, wherein polymer (A) is a polypropylene homo-or copolymer.

8. Composite according to claim 1, wherein the coating layer is an extrusion coating layer.

9. A hygiene product, medical product, roofing material, housing material, or construction material comprising the composite of claim 1.

10. The composite of claim 1, wherein the composite has a WVTR of more than 100 g/[$m^2$/24 h].

11. The composite of claim 1, wherein the comonomer is selected from the group consisting of vinyl acrylate, methyl acrylate and ethyl acrylate.

12. The composite of claim 7, wherein polymer (A) is a propylene homopolymer.

13. The composite of claim 6, wherein the spunbonded fabric comprises a polypropylene having (a) a melt flow rate $MFR_2$ (230° C., 2.16 kg) measured according to ISO 1133 in the range of from 8 to 80 g/10 min; and/or (b) a molecular weight distribution (MWD) measured according to ISO 16014 of not more than 6.0.

14. Composite comprising a nonwoven fabric being the substrate of the composite, wherein the nonwoven fabric comprises a polymer (A) selected from the group consisting of polyethylene, polypropylene, polyethylene terephthalate and polyamide; and a coating layer, wherein the coating layer comprises a polymer (B), wherein said polymer is an ethylene copolymer comprising a comonomer selected from the group consisting of acrylates and methacrylate, wherein said polymer (B) is free of fillers and wherein the coating layer is free of pores, and wherein the coating layer has a weight per unit of area of from 0.1 to 30 g/$m^2$;

whereby the coating layer overlays at least one surface of the nonwoven fabric;

whereby the composite has a water vaper transmission rate (WVTR) according to ASTM E-96 ((water cup method) at 38° C. at 50% RH at the outside of the sample and 100% RH at the inside of the samples) of more than 100 g/[m2/24 h];

wherein no adhesive between the coating layer and the nonwoven fabric is present; and wherein polymer (B) is the only polymer within the coating layer.

* * * * *